US005564395A

United States Patent [19]

Moser et al.

[11] Patent Number: 5,564,395

[45] Date of Patent: Oct. 15, 1996

[54] INTERNAL COMBUSTION ENGINE WITH V-SHAPED BLOCK

[75] Inventors: Franz X. Moser, Kürten; Albert Flotho, Bergisch Gladbach; Hans-Willi Goebel, Köln; Michael Seils, Much, all of Germany

[73] Assignee: Klöckner-Humboldt-Deutz AG, Cologne, Germany

[21] Appl. No.: 347,557

[22] Filed: Nov. 29, 1994

[30] Foreign Application Priority Data

Dec. 1, 1993 [DE] Germany ..... 43 40 885.0

[51] Int. Cl.[6] ..... F02M 37/04

[52] U.S. Cl. ..... 123/509; 123/469

[58] Field of Search ..... 123/509, 507, 123/508, 470, 469, 468

[56] References Cited

U.S. PATENT DOCUMENTS

| | | | |
|---|---|---|---|
| 2,882,884 | 4/1959 | Scheiterlein | 123/509 |
| 3,845,748 | 11/1974 | Eisenberg | 123/468 |
| 4,054,108 | 10/1977 | Gill | 123/509 |
| 4,168,689 | 9/1979 | Parr | 123/509 |
| 4,829,646 | 5/1989 | Cigolotti | 123/509 |
| 5,419,298 | 5/1995 | Nolte | 123/509 |

FOREIGN PATENT DOCUMENTS

| | | | |
|---|---|---|---|
| 4030947A1 | 10/1991 | Germany . | |
| 0210359 | 12/1983 | Japan | 123/469 |
| 0087264 | 5/1984 | Japan | 123/509 |
| 0128965 | 7/1984 | Japan | 13/509 |
| 1237841 | 10/1986 | Japan | 123/509 |

*Primary Examiner*—Carl S. Miller

*Attorney, Agent, or Firm*—Hardaway Law Firm, PA; Charles L. Schwab

[57] ABSTRACT

An internal combustion engine with a V-shaped block is provided with fuel injection apparatus wherein the injection pump elements 16 are inserted in bushings 21, 21a, mounted in the crankcase such a height that the injection line connection 29*a* of each pump element 16 is as close as possible to the injection line pump connection 29*b* of the associated injection valve 9.

22 Claims, 2 Drawing Sheets

INTERNAL COMBUSTION ENGINE WITH V-SHAPED BLOCK

TECHNICAL FIELD

This invention relates to an air-compressing internal combustion engine having an engine block or crankcase in which there is rotatably supported a crankshaft, to which are connected at least two connecting rods each pivotally attached to a piston. The pistons reciprocate in cylinders oriented in V-fashion relative to one another, the cylinders being covered by cylinder heads in which, per assigned cylinder, there is arranged at least one injection valve for fuel. Fuel is supplied to the injection valve through an injection line leading from a pump element driven by a camshaft.

INFORMATION DISCLOSURE STATEMENT

Such an internal combustion engine, as that described above, is disclosed in German patent document DE-OS 40 30 947. In the internal combustion engine described in this document, the pump elements are built into a carrier housing that is mounted in the V-space between the two cylinder rows. This carrier housing encloses a camshaft for the drive of the individual pump elements. In this way, this injection device is nothing other than a modified in-line injection pump that extends over the full length of the internal combustion engine. Disadvantageous in this extended in-line injection pump is the high construction cost and the slight flexibility in terms of special injection requirements.

OBJECTS AND SUMMARY OF THE INVENTION

It is an object of the invention to create an injection device that avoids the disadvantages of the hereinbefore described prior engine construction.

This object is achieved, in a first design, by virtue of the fact that the pump elements are inserted directly into the crankcase and that the camshaft for the actuation of the pump elements is supported in the crankcase. In a second design, the object is achieved by virtue of the fact that the pump elements are inserted into the crankcase with the interposition of a bushing and that the camshaft is supported in the crankcase. By means of both designs, the construction cost is substantially simplified relative to the prior art and a flexible adaptation to special injection requirements is enabled. The supporting of the camshaft in the crankcase does necessitate a redesign of the former crankcase in this region; this, however, represents a one-time measure. By this means, however, by means of supplementing the processing machines, the fabrication of the bearing surfaces for the camshaft, which is advantageously designed as a so-called tunnel shaft, can also be undertaken during the machining of the crankcase. The design of the camshaft as a so-called tunnel shaft means that the bearing surfaces exhibit a larger diameter than the heights of the individual cams. By this means, the camshaft so designed can be pushed into the crankcase from one side of the internal combustion engine without a separation of the bearings. Naturally, it is also possible in the context of the invention to design the camshaft conventionally and to mount it in the crankcase via separable bearings. In this case, this assembly opening in the V-space between the rows of cylinders must be closed by a simple cover. By virtue of the fact that the pump elements are furthermore inserted directly into the crankcase either directly or with the interposition of a bushing, the formerly necessary intermediate casing becomes unnecessary. The manufacturing of the intermediate bushings, on the other hand, does not represent a large construction cost, because these bushings are made simple in design and, furthermore, can also be designed alike for all cylinders of the internal combustion engine. On the other hand, the possibility also arises in this way of enabling the use of diverse pump elements on the internal combustion engine, by means of changes in the intermediate bushing. Also, diverse design forms of the internal combustion engine can be accommodated by means of a change in the overall length of the bushings, such as in an internal combustion engine designed in a long-stroke version in addition to a normal-stroke version. Thus, in this case the injection pump element can be elongated by use of a longer bushing and the replacement of the push rod of the pump element, so that the high-pressure discharge of the pump element ends as near as possible to the injection line connection of the injection valve in the cylinder head. Thus the injection line can be designed as short as possible and the injection device can be designed with a rigidity as great as possible. This rigidity is important for good injection behavior, especially in the high-pressure injection in current use, and is easily possible by virtue of the embodiment according to the invention. It is also provided and possible, in the context of the invention, to fabricate or, respectively, to cast the bushings in one piece with the crankcase. This solution offers itself particularly when no diverse bushing lengths or bushing forms are required for the series of internal combustion engines. Moreover, solenoid-controlled pump elements are preferably used as injection pump elements; it is, however, also possible to use conventional pump elements, which are controlled via a control rod.

In development of the invention, the pump elements assigned to the cylinder rows are oriented at an angular position from 45° to 90° relative to one another. By this means, the injection line connection of the pump element can be placed near the associated cylinder head. Furthermore, it is possible by this means to drive two pump elements from one cam of the camshaft given certain angular positional relationships. This is the case, for example, for an eight-cylinder version of an internal combustion engine if the angular position of 45° of the pump elements bisects the angular position of 90° of the cylinder rows.

In development of the invention, the injection valve is arranged approximately centrally in the cylinder head region assigned to a cylinder and there is provided a connector, which is designed as a thrust piece and is led laterally out of the cylinder head and forms the fuel line connection of the injection valve. This design makes it possible to assign the two injection line connections, of the injection valve and of the pump element, as close as possible.

Here, in development of the invention, a threaded connector is formed on the end of the thrust piece forming the injection line connection. With this threaded connector, the thrust piece is screwed into the cylinder head. Furthermore, an annular groove is recessed in the threaded connector in order to accept a seal ring. In this way, the subsequently described sealing of the annular space against the environment is achieved.

In development of the invention, the connector is inserted into a recess of the cylinder head so as to form an annular clearance, leakage oil escaping from the injection valve being conveyed via the annular clearance to a collecting line arranged along the cylinder row. In this way, a reliably functioning drainage of leakage oil from the injection valves is achieved with simple means, said drainage being sealed off from the exterior of the cylinder head by means of the previously described seal, which is effected in particular by an O-ring.

In development of the invention, the injection line connection of the injection valve and the injection line connection of the pump element of an assigned cylinder are arranged offset to one another in relation to the longitudinal axis of the internal combustion engine. This design makes it possible to facilitate assembly for the injection line, since said injection line can now be assembled with no problem by virtue of the lateral offsetting of the connections. Furthermore, small alignment errors can also be compensated by means of this design, and in particular the injection line can be designed more rigid, because it no longer has to be bent during assembly. In this way, however, a greater rigidity of the injection system as a whole is achieved.

In development of the invention, the injection line connections of injection valves and pump elements of opposing cylinder rows are arranged oppositely offset to one another. By this means it is possible to design the injection lines of all cylinders of the internal combustion engine in unified fashion and thus to reduce the diversity of parts. If this arrangement is not possible, however, then only two distinct injection lines are required for an internal combustion engine, which represents a significant reduction in the diversity of parts relative to an in-line injection pump, in which a specially fabricated injection line is required for every cylinder.

In development of the invention, the bushing exhibits an extension, which is inserted into the crankcase and forms the guide of the roller tappet of the pump element. By means of this design, the pump elements and the bushings can be exactly matched to one another, which is advantageous particularly in the case of diverse pump elements being used, because then the crankcase can always be fabricated with the same opening into which the extension, which exhibits an equal outside diameter in all variations, can be inserted. Here, moreover, the diameters of the bushing and of the opening in the crankcase can be matched to one another in such a fashion that the bushing with the extension can be displaced slightly relative to the crankcase in order to compensate slight alignment errors. If the bushing is fabricated without an extension, the guide of the roller tappet is formed by the crankcase or, respectively, the wall of the opening.

In development of the invention, the delivery of lubricating oil to the pump element and/or to the roller tappet takes place from the crankcase. In this way, external lines and connectors are rendered superfluous. Instead, the required lubricating oil is conveyed directly to the pump element or, respectively, to the roller tappet via a distribution duct into a hole, a duct or, if present, also a groove in the bushing or, respectively, the extension.

In development of the invention, the delivery of fuel and the return of fuel takes place via connecting openings arranged laterally on the bushing. Suitable line pieces can then be simply screwed to these connecting openings. This design has the advantage that the line pieces do not have to be disassembled and assembled in order to change or replace the pump element. Nevertheless, it is also provided in the context of the invention to attach the line pieces directly to the pump elements. If the connecting openings are, however, made on the bushings, said bushings are advantageously arranged one above another. By this means, the connecting lines between the individual bushings or, respectively, pump elements can be designed in straight-line form.

In development of the invention, the lines for fuel delivery and fuel drainage are recessed into a beam. Here a further duct is, if appropriate, also recessed into the beam in order to accept a control rod, and furthermore the beam is fabricated in one piece with the bushings of at least one cylinder row. The fabrication cost is increased only slightly by means of this design, but at the same time the assembly cost is significantly reduced, because no lines having the corresponding connecting screws have to be assembled. At the same time, the danger of the development of leaks, which is always present during an assembly, is eliminated. A control rod is, of course, assembled in the duct only when conventional pump elements are to be installed. Here it is provided either to install a separate control rod for each cylinder row or, however, to provide a single control rod for both cylinder rows, the beam in this solution connecting the bushings of both cylinder rows and, if appropriate, suitable reversing levers being provided for the adjustment of the pump elements.

In development of the invention, the pump element and the bushing are pre-assemblable. This further makes it possible to facilitate assembly, since, in particular, the adjustment of the beginning of fuel injection provided in development is possible during this pre-assembly. Said beginning of fuel injection can be adjusted by virtue of the fact that shims can be interposed between the pump element and the bushing. This work can take place, for example, during pre-assembly and need not be undertaken during the final assembly of the internal combustion engine on an assembly line.

In development of the invention, the camshaft is arranged above an intake and exhaust valve camshaft in the crankcase, and said intake and exhaust valve camshaft is driven directly from the crankshaft and the camshaft directly from the intake and exhaust valve camshaft. This driving can, for example, take place in such a form that a gear is arranged on the crankshaft, which gear, collaboratingly with a gear on the intake and exhaust valve camshaft, reduces the rotation speed of the latter to half the rotation speed of the crankshaft. From this intake and exhaust valve camshaft, the camshaft for the pump elements can then be driven at a rotation speed ratio of 1:1, likewise via gears, which are arranged behind the gears driving the intake and exhaust valve camshaft.

BRIEF DESCRIPTION OF THE DRAWINGS

Advantageous developments of the invention can be understood from the description of the Drawings, in which.

DETAILED DESCRIPTION OF THE DRAWINGS

Figure 1:
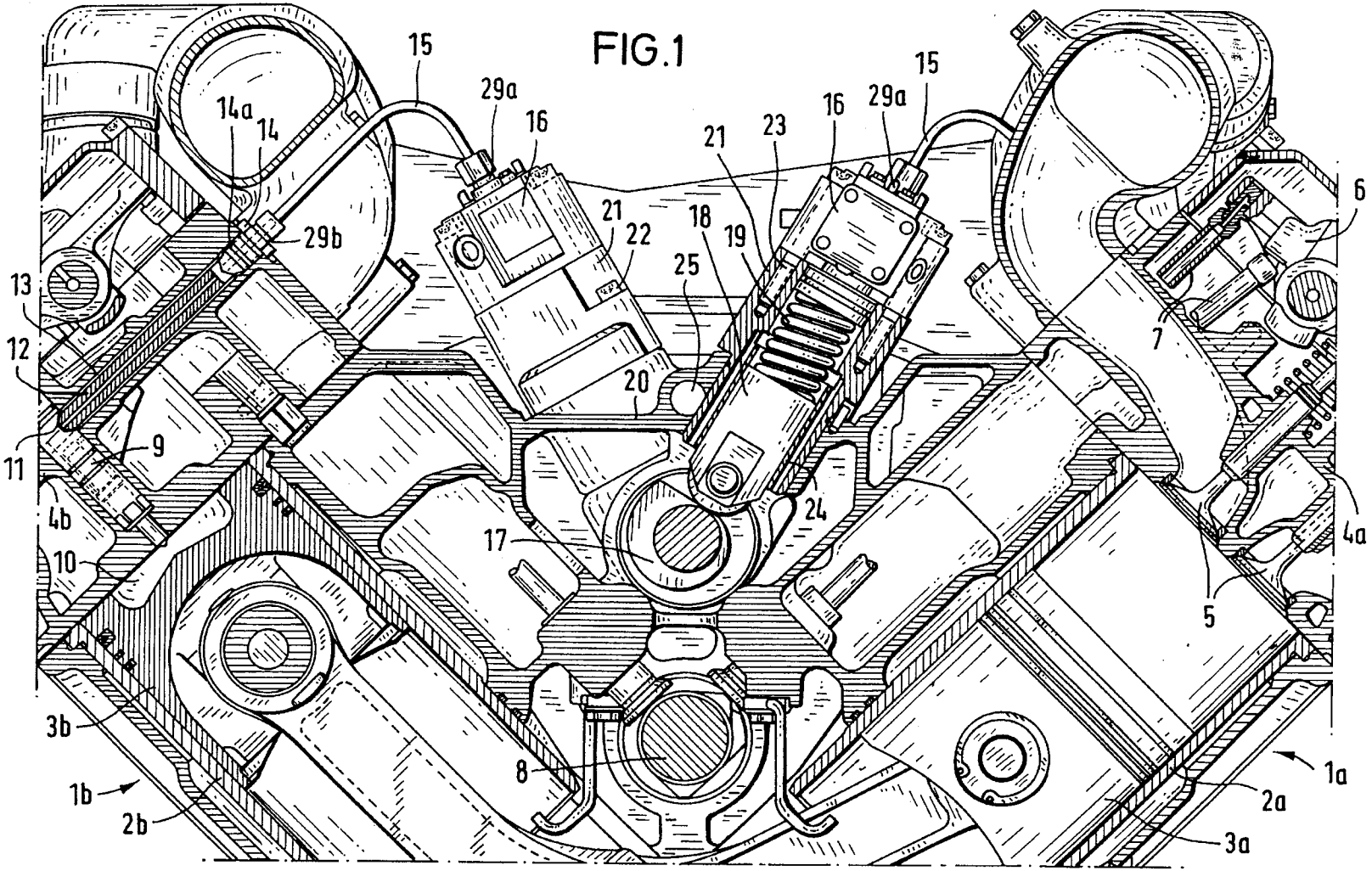
FIG. 1 is a section through an internal combustion engine according to the invention.

The internal combustion engine according to the invention is an air-compressing and direct-injecting internal combustion engine with cylinders 1*a*, 1*b* arranged in V-fashion, at an angle of 90°. Inserted in the cylinders 1*a*, 1*b* are cylinder liners 2*a*, 2*b*, in which pistons 3*a*, 3*b* are movable. The cylinders 1*a*, 1*b* are covered by cylinder heads 4*a*, 4*b*, into which intake and exhaust valves 5 are built, which intake and exhaust valves are actuated by a central intake and exhaust valve camshaft 8 via rocker arms 6 and push rods 7.

In the cylinder heads 4*a*, 4*b*, one injection valve 9 per assigned cylinder 1*a*, 1*b* is inserted. The injection valves 9 are built in centrally in each respective cylinder region and spray the fuel into a combustion cavity 10 recessed into the pistons 3*a*, 3*b*. The injection valves 9 have a conically designed lateral recess 11, into which a thrust piece 12 engages. The thrust piece 12 is inserted into a recess of the cylinder head 4*a*, 4*b* so as to form an annular clearance 13 and is laterally attached to the cylinder head 4*a*, 4*b* in such a form that a threaded connector 14 is formed on the thrust piece 12 on the end lying opposite the recess 11, which threaded connector is screwed into the cylinder head 4*a*, 4*b*. The annular clearance 13 is sealed against the environment by means of an O-ring, which is 1aid in a circular groove 14*a* recessed into the threaded connector 14. The leakage oil escaping from the injection valve 9 is conveyed to the cylinder head side via the annular clearance 13 and from there is conveyed into a collecting line arranged along the cylinder row.

Thus the threaded connector 14 forms the injection line connection 29*b* of the injection valve 9, to which one end of an injection line 15 is attached, the second end of said injection line being attached to the injection line connection 29*a* of a pump element 16. The pump element 16 is a solenoid-controlled injection pump element, which is actuated or, respectively, driven by a roller tappet 18 running on a camshaft 17. The roller tappet 18 transmits the reciprocating motion generated by the cams of the camshaft 17 via a push rod, against the force of a compression spring 18, to a pump plunger, which delivers the delivered fuel into the injection line 15. The beginning of injection, the duration of injection, and the end of injection are controlled by the solenoid-controlled valve.

In order to place the injection line connection 29*a* of the pump element 16 as near as possible to the injection line connection 29*b* of the injection valve 9 and thus to realize an injection line 15 as short as possible, a bushing 21 is arranged between the pump element 16 and the crankcase 20. This is naturally adapted to the length of the push rod of the pump element 16 or, respectively, vice versa. The bushing 21 in turn is attached to the crankcase 20 with screws 22, while the pump element 16 is fixed in the bushing 21 with mounting screws 23. The bushing 21 has an extension 24, which protrudes into the crankcase 20. This extension 24 forms the guide for the roller tappet 18, this component being supplied with lubricating oil from a central lubricating oil line 25 via a hole and/or groove.

Figure 2:
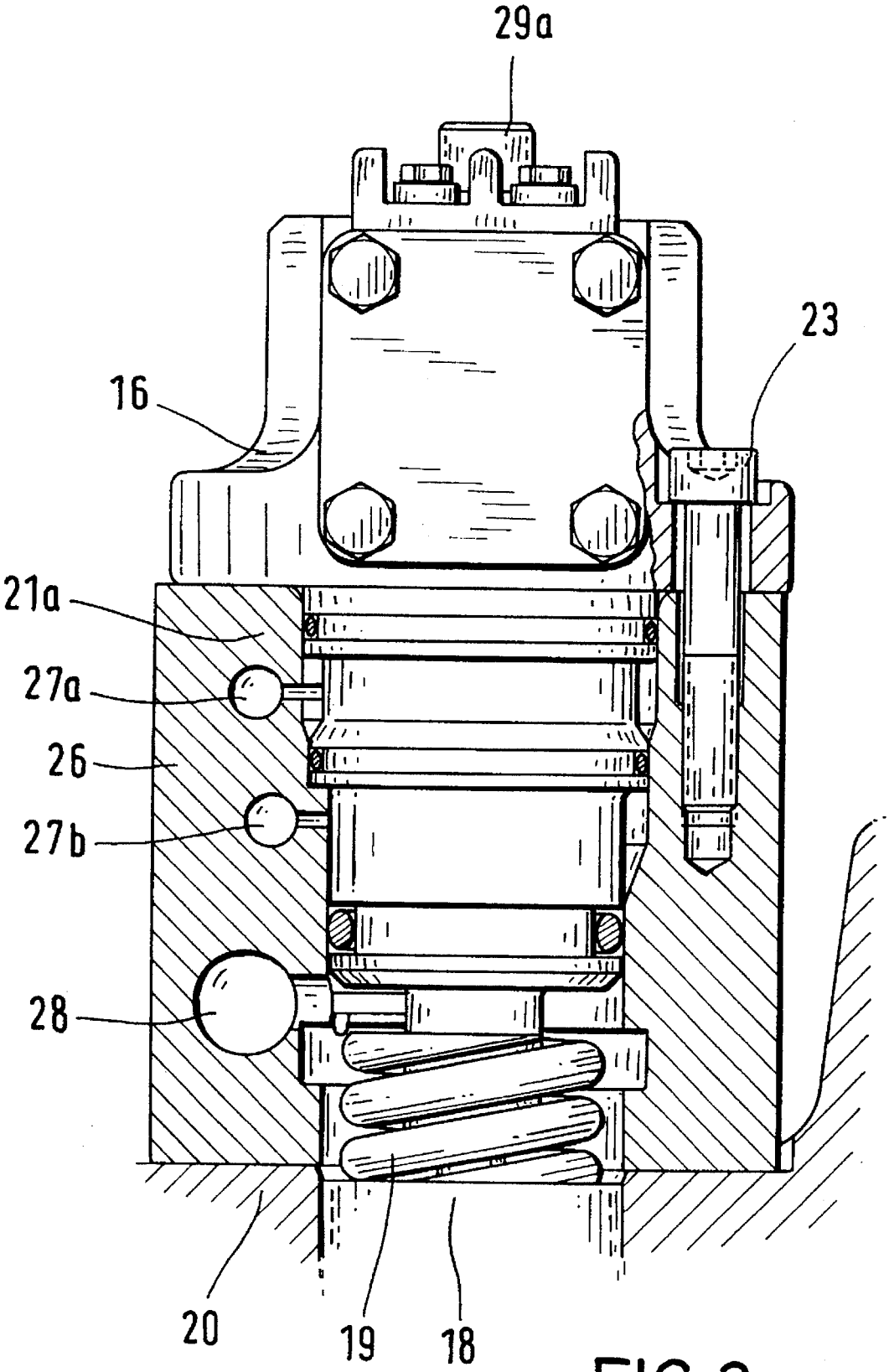
FIG. 2 is a detail view of a bushing with an inserted pump element.

In a modified exemplary embodiment (FIG. 2), a beam 26 is formed in one piece and contains the bushings 21*a* of one cylinder row, a line 27*a* for the fuel delivery and a line 27*b* for the fuel drainage being formed in said beam. In the exemplary embodiment illustrated in FIG. 1, lines serving the purpose of lines 27*a*, 27*b* are attached by appropriate mounting screws to either the pump element 16 or the bushing 21. Further, a guide channel 28 is recessed in the beam 26 if necessary, in order to accept a control rod. A control rod is required when the pump elements 16 are designed conventionally and accordingly the quantity of fuel delivered to the injection valves 9 are determined via a conventional oblique-edge control.

We claim:

1. An air-compressing internal combustion engine comprising:

a crankcase having at least two cylinders whose axes define a V configuration, a crankshaft rotatably supported in said crankcase, a piston in each cylinder, a connecting rod operatively interconnecting each piston to said crankshaft, a cylinder head on said crankcase covering each cylinder, an intake and exhaust valve camshaft (8) rotatably mounted in said crankcase, a first gear drive establishing a direct drive between said crankshaft and said intake and exhaust valve camshaft, a fuel pump element mounted on said crankcase alongside each cylinder, a fuel pump camshaft (17) driving said fuel pump elements, said fuel pump camshaft (17) being rotatably supported by and within said crankcase above said intake and exhaust camshaft (8), a second gear drive establishing a direct drive between said fuel pump camshaft and said intake and exhaust camshaft, said gear drives being arranged one behind the other, an injection valve (9) for each cylinder, each of said injection valves being mounted in the associated cylinder head, an injection line (15) interconnecting each of said injection valves (9) with its associated fuel pump element, and openings in said crankcase (20) for receiving said fuel pump elements (16), said fuel pump elements (16) being inserted directly into said openings in said crankcase (20).

2. An internal combustion engine of claim 1 and further comprising a bushing (21, 21*a*) in each of said openings in said crankcase (20), said pump elements (16) being mounted, respectively, in said bushings (21,21*a*).

3. The internal combustion engine according to claim 1, wherein said pump elements (16) assigned to said two cylinders are oriented at an angular position of from 45° to 90° relative to one another.

4. The internal combustion engine according to claim 2, and further comprising a bushing (21, 21*a*) in each of said openings in said crankcase (20), said pump elements (16) being mounted, respectively, in said bushings (21, 21*a*), a first injection line connection (29*a*) between each of said injection lines (15) and its associated pump element (16) and a second injection line connection (29*b*) between each of said injection lines (15) and its associated injection valve (9), said first injection line connection (29*a*) being in close proximity to said second injection line connection (29*b*).

5. The internal combustion engine according to claim 1 wherein said injection valve (9) is arranged approximately centrally in the cylinder head region and further comprising a connector in the form of a thrust piece (12) extending laterally from said cylinder head (4*a*, 4*b*), said thrust piece (12) forming a fuel delivery connection between said injection valve (9) and its associated injection line.

6. The internal combustion engine according to claim 5, and further comprising an annular passageway in said cylinder heads (4*a*, 4*b*) for each of said injection valves (9), said annual passageways extending from said injection valves (9) to the exterior of said cylinder heads (4*a*, 4*b*), said thrust pieces (12) being inserted into said annular passageway and defining herewith an annular clearance (13) permitting leakage fuel escaping from the injection valve (9) to be conveyed via said annular clearance (13) to a collecting line arranged along the cylinder row.

7. The internal combustion engine according to claim 5 and further comprising an annular passageway in said cylinder heads (4*a*, 4*b*) extending from each of said injection valves to a threaded opening at the exterior of said cylinder heads (4*a*, 4*b*), a threaded connector (14) on said thrust piece (12) at said delivery connection, said threaded connector(14) being in threaded engagement with said threaded opening.

8. The internal combustion engine according to claim 7 and further comprising a circular groove (14*a*) recessed into said threaded connector (14) and an annular seal ring in said circular groove (14*a*) in sealing relation to said annular passageway and said threaded connector (14).

9. The internal combustion engine according to claim 4 wherein said second injection line connection (29*b*) is offset from said first injection line connection (29*a*) in the direction of the axis of said crankshaft of said internal combustion engine.

10. The internal combustion engine according to claim 9 wherein said engine has two rows of cylinders and wherein said first and second injection line connections (29*a*, 29*b*) for one row of cylinders are offset to one another in the opposite direction as said injection line connections (29*a*, 29*b*) for the other row of cylinders are offset to one another.

11. The internal combustion engine according to claim 2 wherein said fuel pump element (9) includes a roller tappet (18) driven by said fuel pump camshaft (17) and wherein said bushing (21, 21*a*) includes an extension (24) extending into said crankcase (20) and forming a guide for said roller tappet (18).

12. The internal combustion engine according to claim 11 and further comprising lubricating oil in said crankcase (20), said lubricating oil serving to lubricate said pump element (16) and roller tappet (18).

13. The internal combustion engine according to claim 2 and further comprising connecting openings for fuel delivery to and fuel return from said pump element (16) positioned laterally on said bushing (21, 21*a*).

14. The internal combustion engine according to claim 13 wherein said connecting openings are arranged one above the other.

15. The internal combustion engine according to claim 13 and further comprising a beam (26) supporting said pump elements (16), a fuel delivery line (27*a*) in said beam (26) in fluid communication with said connecting opening for fuel delivery and a fuel return line (27*b*) in said beam (26) in fluid communication with said fuel return opening.

16. The internal combustion engine according to claim 15 and further comprising a guide duct (28) formed in said beam (26), said guide duct (28) being adapted to receive a control rod.

17. The internal combustion engine according to claim 15 wherein said engine includes two rows of cylinders and wherein said beam (26) is fabricated in one piece and contains said bushings (21*a*) of at least one of said rows of cylinders.

18. The internal combustion engine according to claim 2 wherein each of said pump elements (16) includes lateral connecting openings for fuel delivery and fuel return.

19. The internal combustion engine according to claim 2 wherein said fuel pump element (16) and said bushing (21, 21*a*) are pre-assembled.

20. An air compressing internal combustion engine comprising:

a crankcase having first and second rows of cylinders whose axes define a V configuration, a crankshaft rotatably supported in said crankcase, a piston in each cylinder, a connecting rod operatively interconnecting each piston to said crankshaft, cylinder heads on said crankcase covering said rows of cylinders, said cylinder heads having fuel injection valve openings substantially aligned with said cylinders and an annular passageway extending from each of said injection valve openings to a lateral side of the associated cylinder head which lies within said V configuration, a fuel injection valve in each of said fuel injection valve openings, a fuel pump camshaft (17) rotatably supported by and within said crankcase, said fuel pump camshaft (17) lying within said V configuration, first and second beams (26) mounted on said crankcase (20) within said V configuration in close proximity to said first and second rows of cylinders, respectively, said first and second beams having fuel pump openings for receiving fuel pump elements for said cylinders of said first and second rows of cylinders, respectively, a fuel pump element (16) mounted in each of said fuel pump openings, said fuel pump elements being laterally adjacent to said cylinders, respectively, a roller tappet opening in said crankcase for each of said fuel pump elements (16), a roller tappet (18) in each of said roller tappet openings, each of said roller tappets (18) being aligned with an associated one of said fuel pump elements (16), in operative engagement with said fuel pump camshaft (17) and in reciprocating thrust transmitting engagement with said associated one of said fuel pump elements (16) and fuel delivery lines connecting said fuel pump elements to said fuel injection valves, respectively.

21. The internal combustion engine of claim 20 and further comprising a fuel delivery passage in each of said beams, said fuel delivery passages being in fuel delivery relationship to said fuel pump elements in said beams, respectively, and a fuel return passage in each of said beams, said fuel return passages being in fuel return relationship with said fuel pump elements in said beams, respectively.

22. The internal combustion engine of claim 21 and further comprising a guide channel in each of said beams for receiving a control rod for adjusting said fuel pump elements in the respective beams.

* * * * *